US005215401A

United States Patent [19]

Knight

[11] Patent Number: 5,215,401

[45] Date of Patent: Jun. 1, 1993

[54] DEFLATABLE FASCINE

[75] Inventor: Derek I. Knight, Gosford, Australia

[73] Assignee: The Secretary for Defence in Her Britannic Majesty's Government of the United Kingdom of Great Britain and Northern Ireland, London, England

[21] Appl. No.: 689,898

[22] PCT Filed: Oct. 12, 1989

[86] PCT No.: PCT/GB89/01205

§ 371 Date: Jun. 17, 1991

§ 102(e) Date: Jun. 17, 1991

[87] PCT Pub. No.: WO90/04681

PCT Pub. Date: May 3, 1990

[30] Foreign Application Priority Data

Oct. 24, 1988 [GB] United Kingdom ..... 8824871

[51] Int. Cl.[5] ..... E01C 9/08; E01D 19/00

[52] U.S. Cl. ..... 404/35; 14/78

[58] Field of Search ..... 404/35, 71, 49; 14/78; 405/19

[56] References Cited

U.S. PATENT DOCUMENTS

| | | | |
|---|---|---|---|
| 4,047,257 | 6/1977 | Bondarchuk, Sr. | 14/27 |
| 4,277,201 | 7/1981 | Abell | 404/35 |
| 4,312,601 | 1/1982 | Allen | 405/19 X |
| 4,566,821 | 1/1986 | Knight et al. | 14/78 X |

FOREIGN PATENT DOCUMENTS

| | | |
|---|---|---|
| 0149314 | 1/1984 | European Pat. Off. . |
| 71875 | 9/1893 | Fed. Rep. of Germany . |
| 2449748 | 3/1980 | France . |
| 1176941 | 8/1967 | United Kingdom . |

*Primary Examiner*—Thuy M. Bui
*Assistant Examiner*—Nancy P. Connolly
*Attorney, Agent, or Firm*—Nixon & Vanderhye

[57] ABSTRACT

A ditch filling fascine including a core comprising a plurality of inflatable core members, and a sleeve comprising a multiplicity of axially parallel sleeve members adjacent to one another and connected by at least two flexible ties such as chains. A compressed gas cylinder is provided for inflating the core, and is connected to the core members by a ring main manifold incorporating one way valves for allowing gas to flow into the core members only. The invention also provides a plurality of fascines in combination with a launching vehicle.

11 Claims, 2 Drawing Sheets

DEFLATABLE FASCINE

BACKGROUND OF THE INVENTION

1. Field of the Invention

This invention relates to the field of fascines used for filling gaps.

2. Discussion of Prior Art

It is well known to fill ditches with fascines comprising bound bundles of pipes in order to reduce the discontinuity sufficiently to allow vehicles and personnel to cross the ditch easily. Patent specifications EP 0149314 and GB 2045319 describe examples of such fascine assemblies which have been developed specifically to assist tracked and other vehicles such as tanks in the crossing of ditches.

A problem with existing fascines is that they are very bulky to store and transport, which limits the number that can be transported by and launched from a vehicle.

A further problem with existing fascines is that the pipes in the centre of the fascine are by necessity loosely packed to enable the fascine to conform to the shape of the ditch that it is filling, and the pipes have to be restrained to prevent them sliding out particularly while the fascine is being transported. These central pipes are normally restrained by nets at each end of the fascine the tension of the nets being changed depending on whether the fascine is being transported or deployed in a ditch. This adjustment adds to the complexity of using the existing fascines.

SUMMARY OF THE INVENTION

The object of the invention is to overcome the problems outlined above and in particular to provide a fascine which packs down into a small space yet does not involve the exposure of personnel during deployment.

Thus according to the invention there is provided a fascine including, a sleeve comprising a multiplicity of axially parallel sleeve members transversely and continuously connected by at least two axially spaced flexible tie means, and a core disposed within the sleeve, wherein the core comprises a plurality of inflatable core members.

Preferably the fascine also comprises a gas supply means, which provides the advantage that inflation of the fascine does not require any external pressurized connections. Conveniently the gas supply means is constituted by a source of pressurised gas such as at least one pressurised gas cylinder, and a ring main manifold connecting the gas source to the core members at one or both ends of the fascine. In this way rapid uniform inflation of the fascine can be achieved.

In order to facilitate removal of the gas source even when the fascine is deflated the gas source is preferably located in a rigid housing positioned within the fascine.

Advantageously the gas supply means is isolated from the manifold by a valve which is preferably remotely actuable. This enables the fascine to be deployed without the exposure of personnel.

In order to prevent the whole fascine from deflating if one of the core members or the manifold develops a leak a one way valve is preferably disposed between the manifold and each core member for allowing gas to flow into the core member only.

So that the fascine can be reused even if one of the core members has been punctured, each core member is preferably individually isolatable from the manifold.

This isolation may be effected by a supplementary valve means.

Preferably each core member is provided with a pressure relief valve for limiting the pressure in the core member.

The core conveniently comprises a plurality of closed, inflatable tubes which are axially parallel to the sleeve members. In order to protect the core members from being punctured, the core members preferably do not extend beyond the sleeve when the fascine is inflated and contain resilient restraining means which retract the ends of the core members towards each other as the fascine is deflated.

Each core member preferably comprise a tough outer casing surrounding an air tight inner tube.

The core preferably comprises a central core member surrounded by a plurality of surrounding core members, and the central core member is shorter than its surrounding core members in order to accommodate at least part of the manifold adjacent its end in such a manner that the manifold does not project beyond the ends of the surrounding core members.

The core members are preferably joined together with hook and loop fabric joining means in order to maintain their relative juxtaposition when the fascine is deflated.

Preferably the sleeve members are polyethylene or polypropylene pipes as these are both widely available and are made in sized which are sufficiently strong and resilient to support large tracked vehicles.

Where localised stresses in the sleeve members are likely to be particularly high, the sleeve members may contain one or more reinforcement liners which preferably comprise undersized pipes which are a sliding fit within the sleeve members. These localised high stresses will occur where the sleeve members have to support vehicle tracks.

The invention also provides a plurality of fascines in combination with a fascine launching means adapted for the sequential inflating and launching of the fascines.

BRIEF DESCRIPTION OF THE DRAWINGS

The invention will now be described by way of example only with reference to FIGS. 1 to 4 in which.

DETAILED DISCUSSION OF PREFERRED EMBODIMENTS

Figure 1:
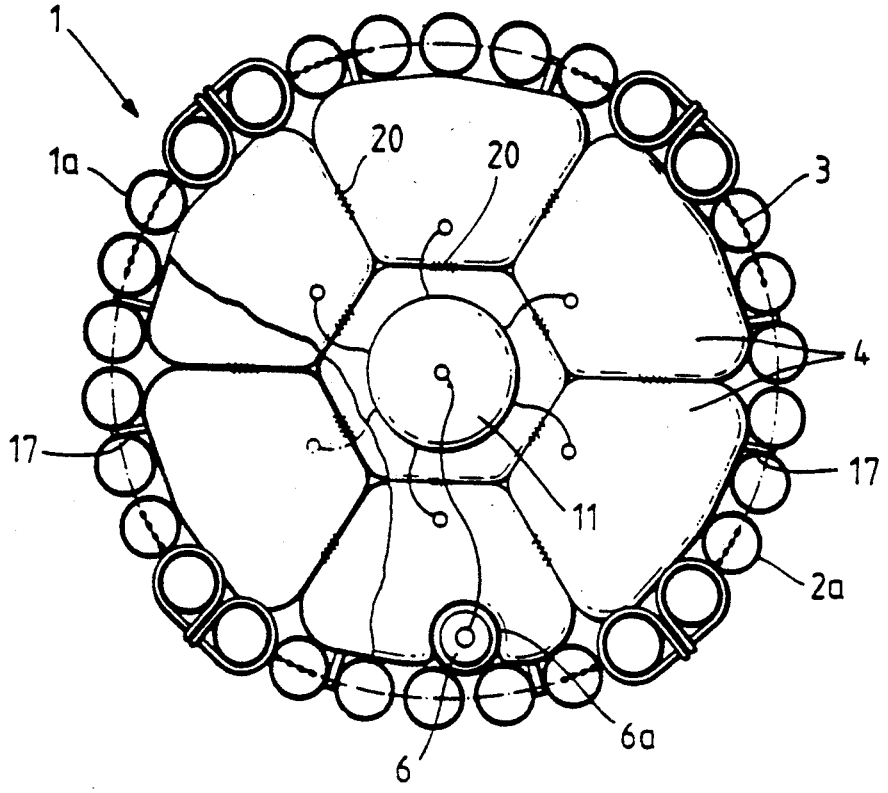
FIG. 1 is an end elevation of a inflatable fascine
Figure 2:
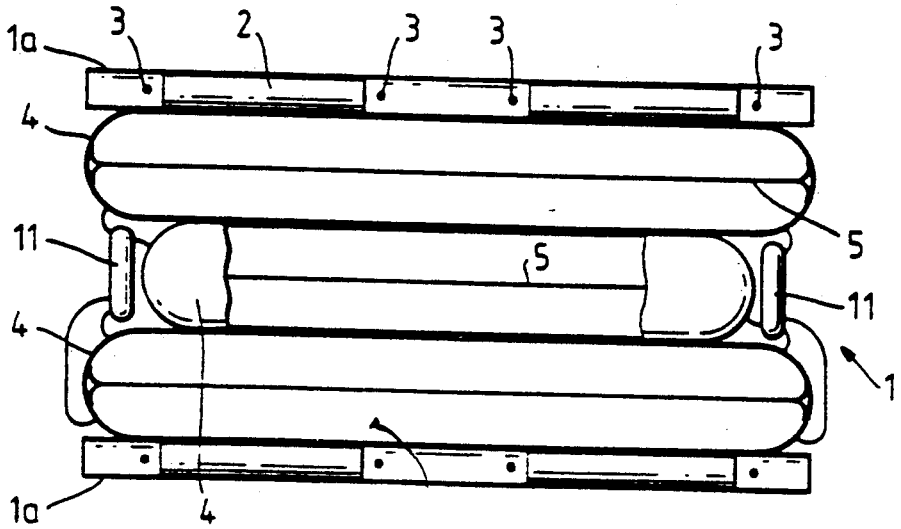
FIG. 2 is a longitudinal cross section through an inflatable fascine

The inflatable fascine 1 of the invention is shown in FIGS. 1 and 2. The sleeve 2*a* forming the outer surface of the fascine comprises longitudinal sleeve members 1*a* which are made from 4.5 m lengths of 220 mm outside diameter, 10 mm thick, high density polyethylene pipe. The sleeve members 1*a* are held in a continuous necklace formation by four chains 3 of 7 mm steel alloy chain. Two reinforcement liners 2 are coaxially located within each sleeve member 1*a*. The liners 2 consist of 1.5 m lengths of 196 mm outside diameter, 6 mm thick high density polyethylene pipe and are located in the two outermost gaps between the chains 3.

Figure 3:
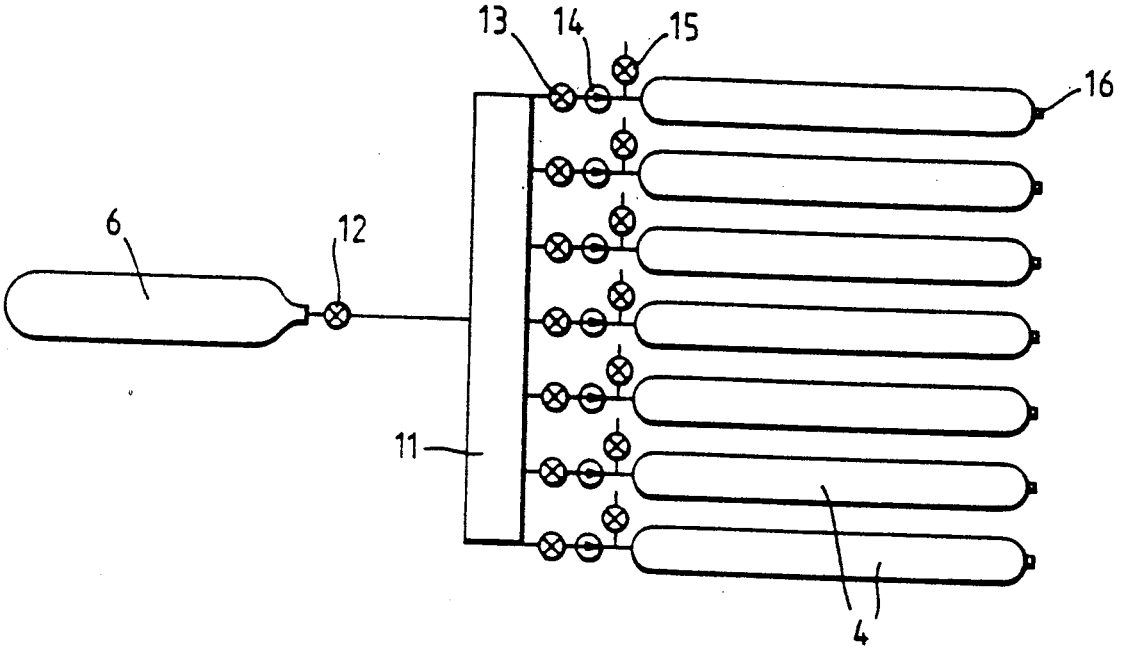
FIG. 3 is a schematic view showing the means for supplying gas to the core members

Seven inflatable core members 4 made from 0.383 kg/m$^2$ fabric of woven aramid fibres such as KEVLAR (RTM) or TWARON (RTM) each containing an air tight inner tube are located inside the sleeve 2*a*. The sleeve 2*a* also houses a compressed gas cylinder 6 in a pipe 6*a*. The compressed gas cylinder 6 is connected to the core members 4 by a ring main manifold 11 which is also shown in FIG. 3. An on/off valve 12 is interposed between the gas cylinder 6 and the manifold 11 in order to control the inflation of the fascine, and one way valve 14 are interposed between the manifold and each core member for allowing gas to flow into the core members only. The one way valves 14 prevent the whole fascine from becoming deflated if one core member 4 is punctured. An on/off valve 13 is interposed between the manifold and each core member, so that if a core member becomes punctured it can be isolated from the manifold before the fascine is reinflated for subsequent deployment. Valves 13 are left open when the fascine is in an undamaged state. Between each one way valve 14 and its associated core member 4 a branch pipe containing an on/off valve 15 is provided to allow the fascine to be deflated after use. Each core member 4 is provided with a pressure relief valve 16. The valves 13, 14 and 15 are located in an easily accessible location.

The central core member is shorter than the surrounding core members in order that a central section of the ring main manifold can be accommodated without protruding from the end of the fascine in either its inflated or deflated state. The central core member may be shorter than the surrounding core members at both ends as shown in FIG. 2 to accommodate a separate manifold with an independent gas supply at each end of the fascine.

The lengths of the core members 4 are such that when they are inflated the ends of each core member 4 lie within the volume enclosed by the sleeve 2*a*, and in order that they are not able to project beyond the ends of the sleeve members 1*a* when the fascine is deflated the ends of each core member 4 are connected by resilient elasticated cords 5 which retract the ends of the core members as the fascine is deflated. The core members 4 are connected to the chains 3 by means of straps 17 which are bonded to the outside of the core members.

The core members are connected to each other by hook and loop joining fabric 20 in order to maintain the relative juxtapositions of the core members when the fascine is deflated. The joining fabric extends over the entire length of the core members.

Figure 4:
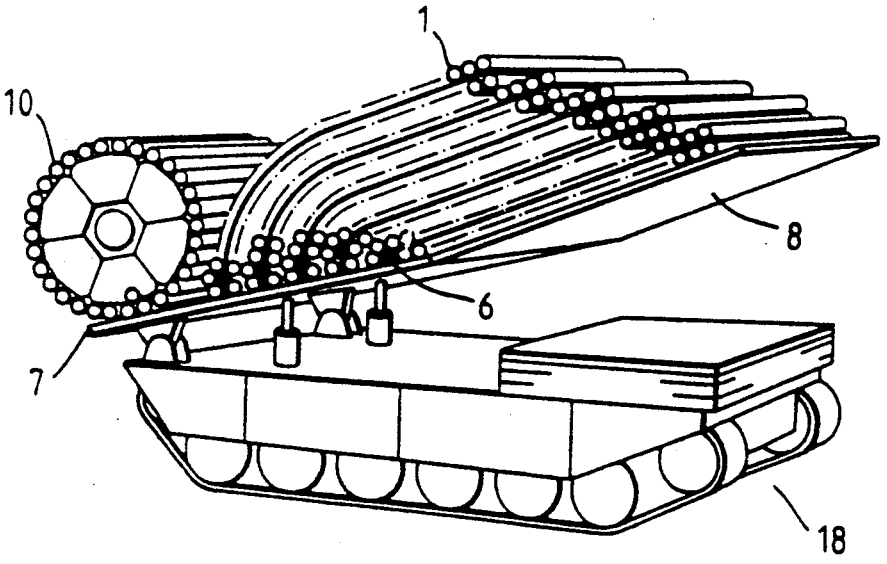
FIG. 4 is a schematic perspective view of a vehicle with six inflatable fascines mounted for sequential deployment.

A launching means is shown in FIG. 4, which is capable of sequentially inflating and launching six fascines constructed according to the invention.

The launching means comprises a platform 7 a ramp 8 and a tracked launch vehicle 18 adapted to carry six deflated fascines 1. The platform 7 is mounted on the launch vehicle 18 and has the six fascines 1 attached to its upper surface. In their deflated state the fascines 1 lay back and are supported by a ramp 8 which slopes upwardly from the rear end of platform 7. Each fascine 1 is arranged with its gas cylinder 6 as near as possible to the point at which the fascine is attached to the platform 7, and electrically or cable actuated mechanisms are provided which firstly allow inflation of the fascine to take place and secondly release the fascine thus allowing it to be launched. This release mechanism is designed to ensure that a fascine can not be inflated or released until all of the fascines in front of it have already been launched.

FIG. 4 shows the first fascine 10 inflated and ready for launching.

In use, the launch vehicle 18 approaches a ditch which is to be crossed by a vehicle and stops at the edge of the ditch. The on/off valve 12 associated with the first fascine 10 is then actuated to allow inflation of this fascine as shown in FIG. 4. When the fascine has been inflated a release mechanism is actuated in order to allow the fascine to roll down the vehicle ramp 8 and into the ditch. Provided a single fascine is of sufficient size to fill the ditch, vehicles and personnel may then pass over the ditch by traversing the upper surface of the fascine. If necessary, more than one fascine may be deployed in a single ditch.

I claim:

1. A ditch filling fascine including:

a sleeve comprising a multiplicity of axially parallel adjacent sleeve members transversely and continuously connected by at least two axially spaced flexible tie means; and a central core, comprised of a plurality of inflatable core members disposed within and being distinct from the sleeve the core being surrounded by the sleeve.

2. A fascine as claimed in claim 1 wherein the fascine further comprises a gas supply means comprising a source of compressed gas and a manifold connecting the gas source to each core member.

3. A fascine as claimed claim 2 wherein the gas supply means comprises at least one ring main manifold.

4. A fascine as claimed claim 2 wherein the core comprises a central core member surrounded by a plurality of surrounding core members, and the central core member is shorter than its surrounding core members in order to accommodate at least part of the manifold adjacent its end in such a manner that the manifold does not project beyond the ends of the surrounding core members.

5. A fascine as claimed in claim 2 wherein each core member is individually isolatable from the manifold.

6. A fascine as claimed in claim 1 wherein the core members are closed inflatable tubes which are axially parallel to the sleeve members.

7. A fascine as claimed in claim 1 wherein each core member contains resilient restraining means which retract opposite ends of the core members towards each other as the fascine is deflated.

8. A fascine as claimed in claim 1 wherein the core members are joined to each other.

9. A fascine as claimed in claim 8 wherein the joining means comprises hook and loop fabric joining means.

10. A plurality of fascines as claimed in claim 1 in combination with a fascine launching means comprising a means for the sequential inflating and launching of the fascines.

11. A plurality of fascines in combination with a launching means as claimed in claim 10 wherein the launching means comprises an inclined platform from which the inflated fascines will automatically roll when released.

* * * * *